US009080292B2

(12) United States Patent
Martinez

(10) Patent No.: US 9,080,292 B2
(45) Date of Patent: Jul. 14, 2015

(54) METHOD OF FORMING A BASE AROUND AN UPRIGHT SUPPORT FOR A MAILBOX

(71) Applicant: Ronald Martinez, Joliet, IL (US)

(72) Inventor: Ronald Martinez, Joliet, IL (US)

( * ) Notice: Subject to any disclaimer, the term of this patent is extended or adjusted under 35 U.S.C. 154(b) by 0 days.

(21) Appl. No.: 14/063,746

(22) Filed: Oct. 25, 2013

(65) Prior Publication Data

US 2015/0117950 A1 Apr. 30, 2015

(51) Int. Cl.
*E01C 5/00* (2006.01)

(52) U.S. Cl.
CPC ..... *E01C 5/00* (2013.01)

(58) Field of Classification Search
USPC ..... 404/32–35, 73; 40/566, 607.1, 607.06; 232/38, 39
See application file for complete search history.

(56) References Cited

U.S. PATENT DOCUMENTS

| | | | | | |
|---|---|---|---|---|---|
| 4,642,946 | A * | 2/1987 | Koch | 52/38 |
| 4,648,203 | A * | 3/1987 | Worzek | 47/32 |
| 5,065,543 | A * | 11/1991 | Brook | 47/30 |
| 5,522,176 | A * | 6/1996 | Suttle | 47/32 |
| 5,640,821 | A * | 6/1997 | Koch | 52/698 |
| 5,787,637 | A * | 8/1998 | Keen | 404/34 |
| 5,816,738 | A * | 10/1998 | Harnapp | 404/18 |
| 7,344,334 | B2 * | 3/2008 | Thorkelson | 404/29 |
| 7,540,684 | B1 * | 6/2009 | Lukasik | 404/33 |
| 2011/0052318 | A1 * | 3/2011 | Smith et al. | 404/73 |

* cited by examiner

*Primary Examiner* — Abigail A Risic
(74) *Attorney, Agent, or Firm* — Wood, Phillips, Katz, Clark & Mortimer

(57) ABSTRACT

A method of forming a base around a mailbox that is mounted upon a support assembly that projects upwardly from a surface on subjacent ground. The method includes the steps of: obtaining a plurality of base components each with an upwardly facing surface; and operatively placing and connecting the plurality of base components so that at least first and second of the base components are connected, each to the other, so that the upwardly facing surfaces on the plurality of base components cooperatively define an upwardly facing surface area over the subjacent ground surface.

4 Claims, 3 Drawing Sheets

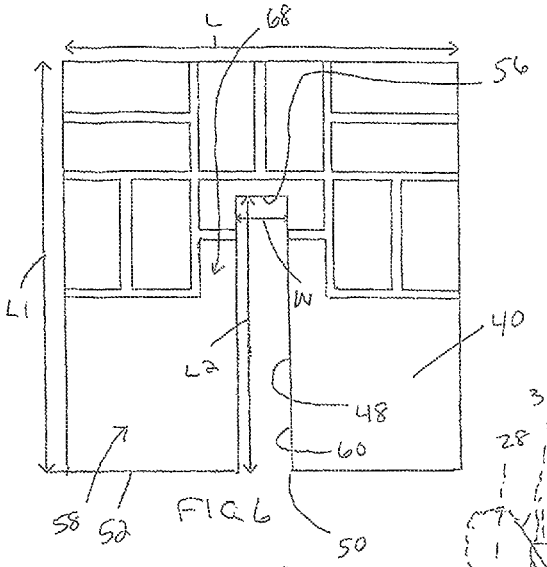
FIG 6
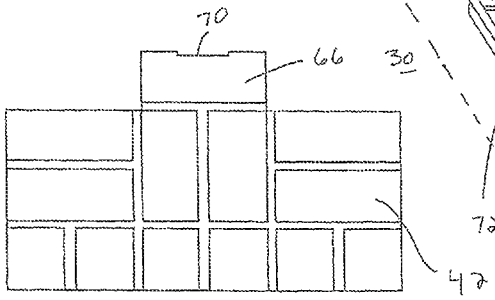
FIG 5
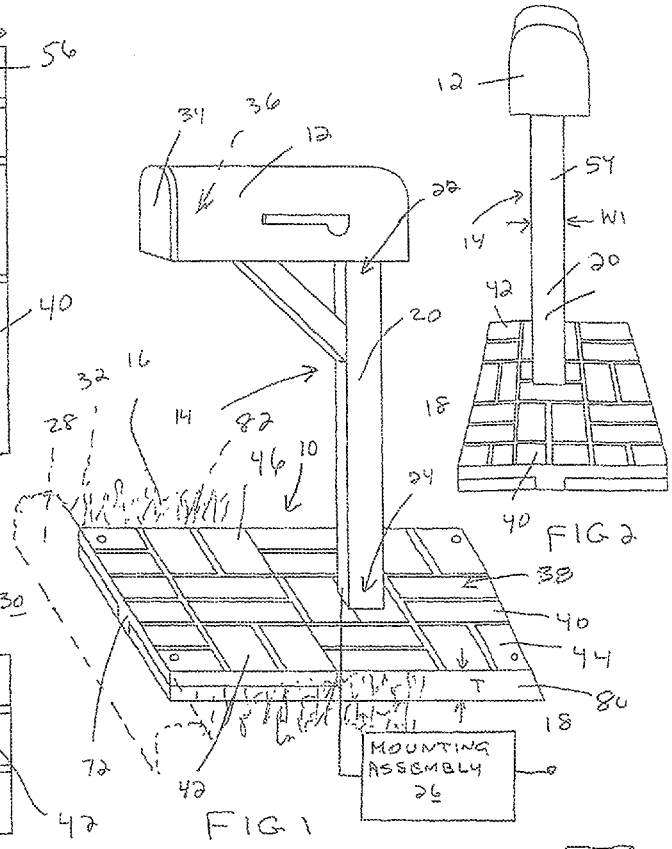
FIG 2
FIG 1
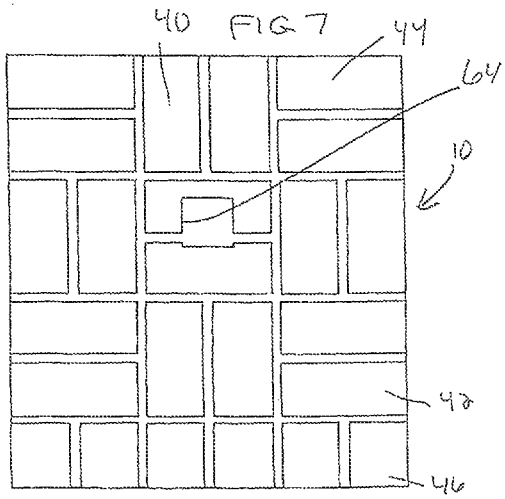
FIG 7
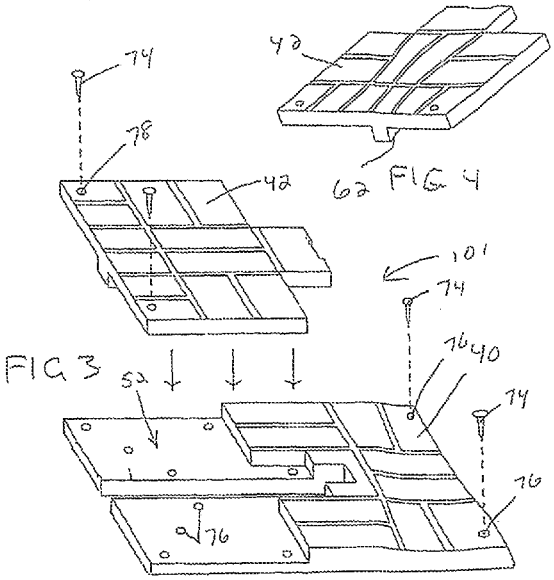
FIG 4
FIG 3

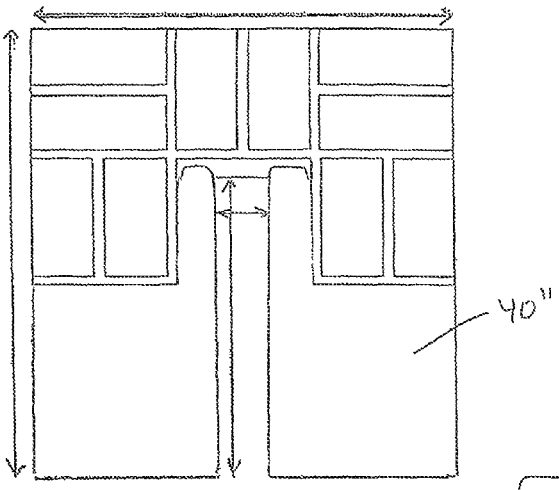
FIG 13
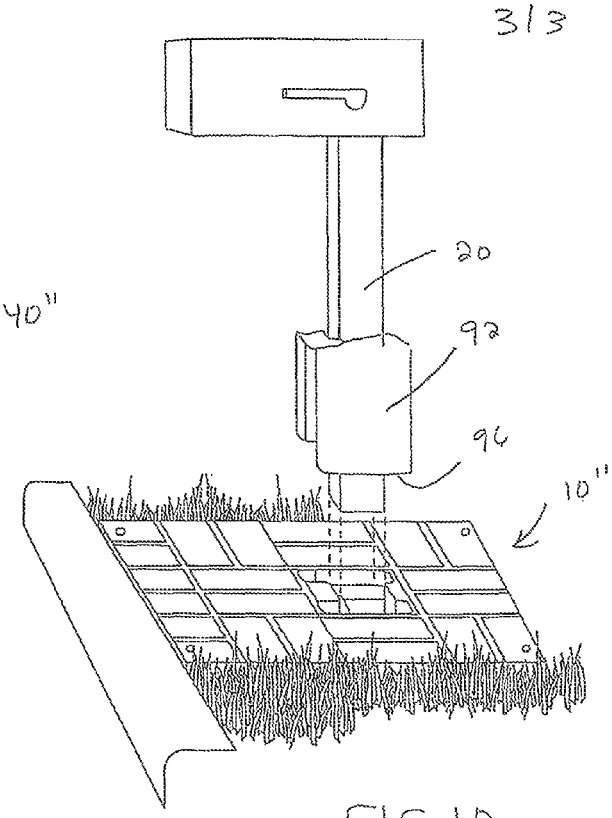
FIG 10
FIG 12
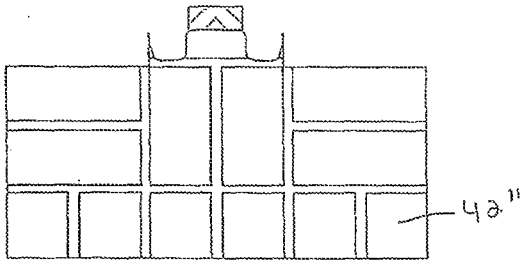
FIG 14
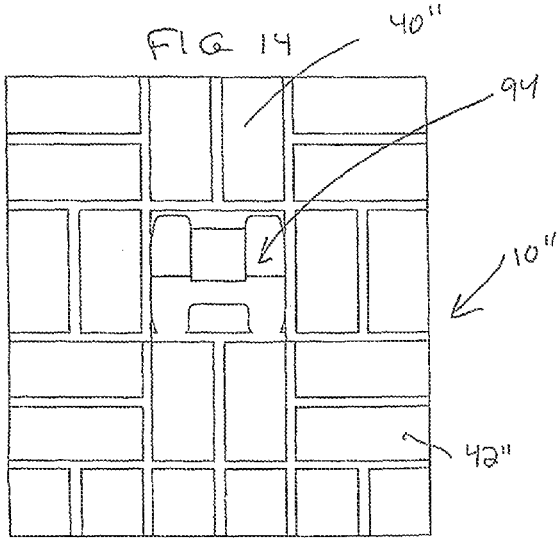
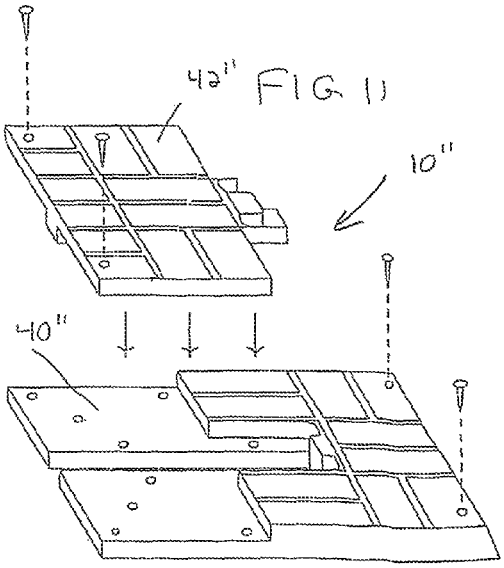
FIG 11

METHOD OF FORMING A BASE AROUND AN UPRIGHT SUPPORT FOR A MAILBOX

BACKGROUND OF THE INVENTION

1. Field of the Invention

This invention relates to mailboxes typically placed at curbside locations and, more particularly, to a base that extends around a support for the mailbox.

2. Background Art

In many communities, mailboxes are placed on or adjacent to individual properties to be accessible to a delivery person operating a vehicle on an adjacent roadway. A typical mailbox has a housing defining a receptacle that is accessed through a hinged door. The housing is supported on an upright component, such as a vertical post, that is secured at and/or in the subjacent ground.

At a curbside location, the post will commonly be offset inwardly from the curb. At the top of the post, the mailbox is secured to cantilever towards the roadway so that it is conveniently accessible to a person operating a delivery vehicle on the roadway.

In the vast majority of locations at which mailboxes are mounted, grass is planted at the surrounding ground region. This may be directly on a user's property or on a parkway, as is typically present with a sidewalk.

Homeowners and businesses generally attempt to integrate the mailbox and the support therefor into the adjacent landscaping so that the mailbox and support do not stand out or appear unsightly. With existing support systems, this objective creates a constant challenge.

As one example, the mailbox support may consist of a round metal or wood post or a square wood post that is inserted into the ground. Concrete may be used to rigidify the anchoring of the bottom of the post. The ground surface region around the bottom of the post is commonly improved in appearance by planting grass including at that region between the post and an adjacent curb.

Commonly, the dimension between the bottom of the post and the curb is not adequate to accommodate a conventional lawn mower. Thus, the individuals maintaining the surrounding region generally have the option of either cutting the lawn using a portable trimmer, such as a line trimmer, or allowing the grass to grow out of control between the post and curb and around the post. This problem becomes more significant in the event that businesses and homeowners do not possess line trimmers that would facilitate this localized grooming.

A third alternative is to try to maneuver a conventional mower in this space to cut some or all of the grass in this area. At best this is inconvenient, even if somewhat effective. If care is not taken, the mower might be damaged. In a worse case, there is a possibility that the mower operator might be injured attempting the activity.

As an alternative to planting grass, some home and business owners may choose to use concrete and/or pavers around the post, including the region between the post and the curb. For those persons who do not have the ability to pour concrete or lay pavers, a significant expense may be involved. Even after such a project is completed, concrete is prone to cracking and pavers are prone to settling and shifting. This problem is aggravated by grass that may grow through any cracks or openings. All of these conditions make for an unsightly appearance around the mailbox support.

As an alternative, some home and business owners integrate flowers and/or plants around the support. This approach introduces another ongoing maintenance challenge. Since much of this vegetation is seasonal, at certain times of the year, even with a dedicated effort to maintain plants and flowers, the region around the support may become unsightly.

As a result, if one tours a neighborhood with multiple residences, a wide range of looks around mailboxes can be observed. Aside from the fact that many of the steps taken to improve the appearance around mailboxes are ineffective, the many attempted solutions cause a deviation from uniformity that is required in many communities by local covenants, etc.

Heretofore, no practical, effective, and affordable solution is known to be available to home and business owners to improve the region around mailboxes and their supports.

SUMMARY OF THE INVENTION

In one form, the invention is directed to a method of forming a base around a mailbox that is mounted upon a support assembly that projects upwardly from a surface on subjacent ground. The method includes the steps of: obtaining a plurality of base components each with an upwardly facing surface; and operatively placing and connecting the plurality of base components so that at least first and second of the base components are connected, each to the other, so that the upwardly facing surfaces on the plurality of base components cooperatively define an upwardly facing surface area over the subjacent ground surface.

In one form, the step of operatively placing and connecting the plurality of base components involves placing the first and second base components in horizontally overlapped relationship.

In one form, the operatively placed and connected base components cooperatively extend continuously fully around the support assembly.

In one form, the subjacent ground surface includes an adjacent curb with an edge. The operatively placed and connected base components extend adjacent to the edge along a substantial length of the edge.

In one form, the method further includes the step of directing an anchor through at least one of the base components and into the subjacent ground.

In one form, the method further includes the step of directing an anchor through overlapped portions of the first and second base components and into the subjacent ground.

In one form, the operatively placed and connected base components cooperatively define a through opening that is nominally matched to a cross-section of a portion of the support assembly.

In one form, the first base component has a first guide assembly and the second base component has a second guide assembly. The method further includes the step of relatively moving the first and second base component to cause the first and second guide assemblies to move one against the other to consistently guide the first and second base components between a pre-assembly relationship and an assembled relationship.

In one form, the first guide assembly has a rail and the second guide assembly has a slot in which the rail is guided in a substantially straight line path.

In one form, the portion of the support assembly has a peripheral surface that in cross-section is non-circular in shape.

In one form, the upwardly facing surface on one of the base components has a simulation of pavers thereon.

In one form, a plurality of the base components are made from a non-metal material.

In one form, a plurality of the base components are made using a molding process.

In one form, the subjacent ground includes a curb with a length and a lengthwise edge. The operatively placed and connected base components include an upwardly facing surface area extending substantially fully between the lengthwise curb edge and the support assembly.

In one form, the upwardly facing surface area conforms to the lengthwise curb edge over a substantial distance.

In one form, the anchor is in the form of a headed spike.

In one form, the portion of the support assembly is keyed in the through opening so that the plurality of operatively placed and connected base components cannot be turned continuously through 360° relative to the portion of the support assembly around a vertical axis.

In one form, the support assembly is operatively mounted with respect to the subjacent ground independently of the plurality of base components.

In one form, the upwardly facing surface area has a polygonal shape.

In one form, the plurality of base components consists of two and only two of the base components.

BRIEF DESCRIPTION OF THE DRAWINGS

FIG. 1 is a fragmentary perspective view of one form of base, according to the invention, operatively situated relative to a mailbox on a support assembly at a curbside location;

FIG. 2 is a reduced view of the components in FIG. 1 taken from a different perspective;

FIG. 3 is an exploded perspective view of first and second base components making up the base in FIGS. 1 and 2;

FIG. 4 is a perspective view of the second base component;

FIG. 5 is an enlarged, plan view of the second base component;

FIG. 6 is an enlarged, plan view of the first base component;

FIG. 7 is an enlarged, plan view of the base with the first and second components assembled;

FIGS. 10-14 correspond successively to FIGS. 1, 3, and 5-7 and show a modified form of base, according to the present invention.

DETAILED DESCRIPTION OF THE PREFERRED EMBODIMENT

Figure 8:
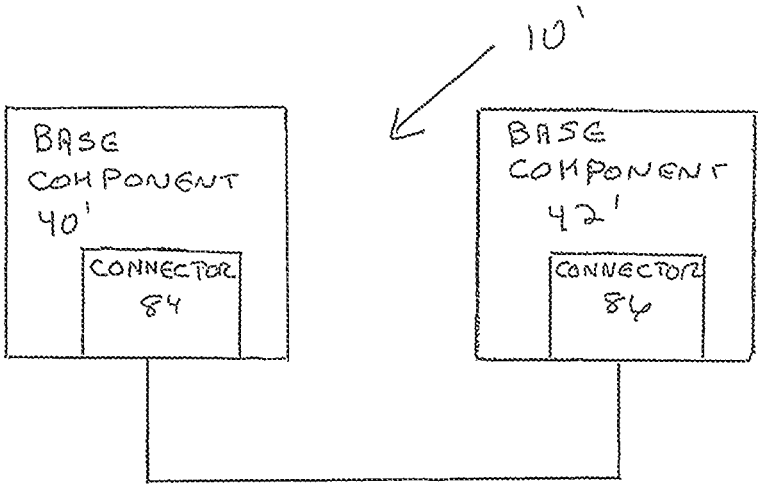
FIG. 8 is a schematic representation of a base, according to the present invention.

One form of the invention will be described with respect to FIGS. 1-7. In FIGS. 1-7, a base 10 is shown formed around a mailbox 12 that is mounted upon a support assembly 14 that projects upwardly from a surface 16 on subjacent ground 18. In this embodiment, the support assembly 14 consists of a vertically extending post 20 with a top 22 and bottom 24. The mailbox 12 is mounted at the top 22 of the post 20 to project in cantilever fashion away from the post 20. The bottom 24 of the post 20 is operatively mounted with respect to the subjacent ground 18 by any suitable mounting assembly, as shown generically at 26. The mounting assembly 26 may be supported on the surface 16 or directed into the subjacent ground 18 for suitable anchoring. As one example, the post 20 may be made from wood and may be anchored by being directed into a blind bore in the subjacent ground 18. Compacted dirt and/or concrete may be utilized to rigidify the mounting of the post 20.

The generic showing of the mounting assembly 26 is intended to encompass virtually all known constructions commonly utilized for mounting an upright component fixedly in subjacent ground 18. As just one other example, metal components are commonly provided at the bottom region of such posts 20 to be forcibly directed into the ground.

As seen in FIG. 1, the post 20 is situated adjacent to a curb 28 running along the side of a roadway 30. The curb 28 has a running edge 32 that follows the contour of the roadway 30. The distance between the post 20 and edge 32 is selected so that a hinged access door 34 is accessible to an individual operating a vehicle on the roadway 30 to allow opening thereof and placement of mail contents in an internal receptacle 36.

The base 10 is preferably constructed so that it overlies the ground surface 16 in the region between the post 20 and the curb edge 32. In a most preferred form, the base 10 extends fully around the post 20 to define an upwardly facing surface 38 that is desirable in terms of its appearance and its ability to block vegetation growth in the region underlying the base 20.

The base 20 is made up of a plurality of base components—in this embodiment first and second base components 40, 42—with upwardly facing surfaces 44, 46, respectively, to cooperatively define the upwardly facing overall base surface 38.

In this embodiment, the upwardly facing surfaces 44, 46 have simulations of pavers thereon. The surface could be plain, textured, or with design, coloration, etc. to simulate a material and/or provide one of virtually an unlimited number of cosmetically pleasing designs or patterns.

The first base component has a generally "U" shape defined by a slot 48 formed partially therethrough. The slot 48 has a width dimension W that is slightly greater than the width W1 of the post 20. This allows the post 20 to be aligned with an entry 50 to the slot 48 at a front edge 52 of the base component 40. The base component 40 can then be slid forwardly until a back wall 54 of the post 20 abuts to a back edge 56 of the slot 48.

The base component 40 is undercut at a front region 58 to accommodate the second base component 42.

An edge 60 bounding the slot 48 defines a first guide assembly that cooperates with an elongate rail 62 on the second base component that defines a second guide assembly. The guide assemblies cooperate to guide the first and second base components 40, 42 between a pre-assembly relationship, as shown in FIG. 3, and an assembled relationship, shown in FIGS. 1, 2, and 7. This relative movement can be guided vertically and/or horizontally generally in a straight line to cause the second base component 42 to nest in the undercut front region 58.

With the first and second base components 40, 42 operatively placed and connected, a through opening 64 is cooperatively defined by the base components 40, 42 that is at least nominally matched to the cross-sectional shape of a portion of the support assembly 14. In this case, the through opening 64 is approximately square to match the square shape of the post 20.

In this embodiment, the second base component 42 has a discrete projection 66 that nests in an accommodating, undercut receptacle 68 on the base component 40. This allows the base components 40, 42 to be keyed to each other so as to be confined against relative movement in a horizontal plane. In this embodiment, the projection 66 has an undercut 70 that bounds part of the through opening 64. However, the invention is not limited to this construction, as any cooperating arrangement of the base components 40, 42 that produces a fully surrounded through opening 64 is contemplated.

With the base components 40, 42 operatively placed and connected, they cooperatively define a front edge 72 that extends adjacent to the curb edge 32 along a substantial length thereof. An exemplary dimension L for this edge 72 is 27.5 inches. This dimension is one that is based largely on design versus function, as the dimension could be substantially less or substantially greater. Preferably, the dimension L is selected so that a conventional lawnmower can be maneuvered around the front of the support assembly 14 conveniently to trim all exposed grass in the vicinity of the base 10 and support assembly 14.

The fore-and-aft dimension L1 of the base 10 is also a matter of design choice. In one preferred form, the dimension L1 is on the order of 30 inches. The dimension L2 of the slot 48 is selected to situate the base edge 72 adjacent to the curb edge 32. The thirty inch dimension for L1 normally will extend the base 10 rearwardly behind the support assembly 14, again to facilitate mowing around the base 10 and post 20. Of course, all these dimensions are selected based upon the particular site conditions and desired aesthetic look.

Further, the shape of the base, as viewed in vertical plan, depends greatly upon aesthetic preference. While a polygonal shape is shown, virtually an unlimited number of different shapes are contemplated that can afford the primary advantage of facilitating mowing and blocking vegetation growth. Preferably, the base 10 is constructed so that the base components 40, 42 provide a solid barrier against vegetative growth from the region there-underlying.

To facilitate securement of the base to the subjacent ground 18, and the base components 40, 42 to each other, anchors 74 are utilized. While any type of anchor can be utilized, a headed spike is preferred since it can be readily driven into the subjacent ground 18. Strategically placed, pre-formed through openings 76 are provided in the first base component 40, with similar through openings 78 provided in the second base component 42.

With this arrangement, once the first base component 40 is operatively placed, one or more anchors 74 can be driven into place. The anchor 74 might be driven through the undercut region 58 before the second base component 42 is placed. Once the second base component 42 is operatively placed, anchors 74 can be driven through the first and second base components 40, 42 where they are horizontally overlapped.

With this arrangement, the base 10 becomes effectively locked in place through the cooperation of a number of different surfaces and edges. The adjacent relationship between the edge 72 and the curb edge 32 prevents skewing of the base 10. Further, the post 20 is keyed in a through opening 64 so that the base 10 cannot be turned continuously through 360° around a vertical axis relative to the post 20. The base components 40, 42 are keyed to each other and anchored to the subjacent ground 18. Overall, this arrangement maintains the base firmly in place and against skewing as when a mower is directed thereagainst and thereover.

While the post 20 is shown with a conventional square/polygonal shape, it is contemplated that the post 20 might be a component with a round peripheral surface, such as a conventional metal or non-metal pipe. Such a post configuration, while not keying itself within the through opening 64, does otherwise maintain the base 10 in place, i.e., against horizontal shifting in potentially all directions.

In one preferred form, the base components 40, 42 are made from a non-metal material, though this is not a requirement. Non-metal construction facilitates formation by a molding process, which is preferred.

The combined thickness T of the base 10 may be on the order of 3 inches; however, thicknesses less or greater than 3 inches are contemplated. The thickness may depend upon whether the subjacent ground 18 is removed to produce a flush relationship between the surface 38 and the surface 16 of the subjacent ground 18 or whether it is desirable to have some vertical projection evident. In the latter case, it may be desirable to incline the peripheral edge 80 so that mowing equipment does not hang up at the edge 80 as grass 82 in the vicinity of the base 10 perimeter is cut.

While the support assembly 14 is operatively mounted with respect to the subjacent ground 18 independently of the base 10, the base 10 could be constructed to rigidify the anchoring of the support assembly 14.

In FIG. 8, components utilized to form a base, according to the present invention, are depicted in schematic form. In its simplest form, the base 10' consists of first and second base components 40', 42' with the base component 40', 42' having connectors 84, 86 that interact with the base components operatively placed and connected. The schematic showing in FIG. 8 is intended to encompass the specific forms of the base components and connectors, described herein, and other variations consistent with the inventive teachings.

Figure 9:
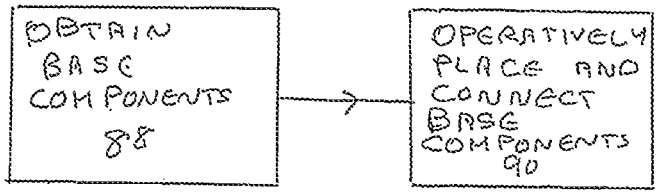
FIG. 9 is a flow diagram representation of a method of forming a base, according to the invention.

In FIG. 9, a flow diagram representation of a method of forming a base, according to the present invention, is shown. As shown at block 88, the base components as described in FIG. 8, are obtained. As shown at block 90, the base components are operatively placed and connected as described herein.

In FIGS. 10-14, one variation of base, according to the present invention, is shown at 10". The base 10" is made up of base components 40", 42", corresponding to the base components 40, 42.

The only difference between the base 10" and base 10 is in a configuration that accommodates a decorative housing 92 that surrounds the post 20. Only a short vertical length of the housing 92 is shown. The housing 92 typically will extend over the full height of the post 20 and around a mailbox receptacle. The housing 92 performs primarily an aesthetic function and can be integrated into the base to give a more aesthetically pleasing appearance. In this particular embodiment, the portion of the housing 92 that seats in the base 10" has an "H" shape in cross-section. With the base components 40", 42" operatively positioned and connected, the base components 40", 42" cooperatively define a vertically undercut, upwardly opening receptacle 94 at least nominally matched to the "H" shape of the housing 92. The lower edge 96 of the housing 92 nests in the receptacle 94 so that the housing 92 appears to blend into the base 10".

The foregoing disclosure of specific embodiments is intended to be illustrative of the broad concepts comprehended by the invention.

The invention claimed is:

1. A method of forming a base around a mailbox that is mounted upon a support assembly that projects upwardly from a surface on subjacent ground, the method comprising the steps of:

obtaining a plurality of base components each with an upwardly facing surface;

operatively placing and connecting the plurality of base components so that at least first and second of the base components are connected, each to the other, so that the upwardly facing surfaces on the plurality of base components cooperatively define an upwardly facing surface area over the subjacent ground surface, wherein the step of operatively placing and connecting the plurality of base components comprises placing the first and second base components in horizontally overlapped relationship; and directing an anchor through overlapped portions of the first and second base components and into the subjacent ground.

2. A method of forming a base around a mailbox that is mounted upon a support assembly that projects upwardly from a surface on subjacent ground, the method comprising the steps of:

obtaining a plurality of base components each with an upwardly facing surface;

operatively placing and connecting the plurality of base components so that at least first and second of the base components are connected, each to the other, so that the upwardly facing surfaces on the plurality of base components cooperatively define an upwardly facing surface area over the subjacent ground surface, wherein the first base component has a first guide assembly and the second base component has a second guide assembly; and further comprising the step of relatively moving the first and second base component to cause the first and second guide assemblies to move one against the other to consistently guide the first and second base components between a pre-assembly relationship and an assembled relationship.

3. The method of forming a base around a mailbox according to claim 2 wherein the first guide assembly comprises a rail and the second guide assembly comprises a slot in which the rail is guided in a substantially straight line path.

4. A method of forming a base around a mailbox that is mounted upon a support assembly that projects upwardly from a surface on subjacent ground, the method comprising the steps of:

obtaining a plurality of base components each with an upwardly facing surface; and operatively placing and connecting the plurality of base components so that at least first and second of the base components are connected, each to the other, so that the upwardly facing surfaces on the plurality of base components cooperatively define an upwardly facing surface area over the subjacent ground surface, wherein the operatively placed and connected base components cooperatively define a through opening that is nominally matched to a cross-section of a portion of the support assembly, wherein the portion of the support assembly is keyed in the through opening so that the plurality of operatively placed and connected base components cannot be turned continuously through 360° relative to the portion of the support assembly around a vertical axis.

* * * * *